United States Patent [19]

Lovatt

[11] 4,315,738

[45] Feb. 16, 1982

[54] SUPPORT ELEMENT, UPRIGHT SUPPORT AND SUPPORT STRUCTURE FOR SUPPORTING ARTICLES DURING KILN FIRING

[75] Inventor: William J. Lovatt, Stoke on Trent, England

[73] Assignee: Acme Marls Limited, England

[21] Appl. No.: 142,245

[22] Filed: Apr. 21, 1980

[30] Foreign Application Priority Data

Apr. 14, 1980 [EP] European Pat. Off. ..... 80102003.3

[51] Int. Cl.[3] ..... F27D 5/00

[52] U.S. Cl. ..... 432/258; 432/259

[58] Field of Search ..... 432/258, 259

[56] References Cited

U.S. PATENT DOCUMENTS

| | | | |
|---|---|---|---|
| 1,846,614 | 2/1932 | Rowland | 432/241 |
| 2,537,145 | 1/1951 | Lovatt et al. . | |
| 3,756,581 | 9/1973 | Alber tini | 432/2 |
| 4,110,069 | 8/1978 | Lovatt | 432/258 |

FOREIGN PATENT DOCUMENTS

| | | | |
|---|---|---|---|
| 91289 | 2/1896 | Fed. Rep. of Germany . | |
| 889726 | 9/1953 | Fed. Rep. of Germany . | |
| 2151887 | 4/1972 | Fed. Rep. of Germany . | |
| 199332 | 6/1978 | Fed. Rep. of Germany | 432/258 |
| 2816278 | 10/1978 | Fed. Rep. of Germany | 432/258 |
| 673045 | 5/1952 | United Kingdom . | |

*Primary Examiner*—John J. Camby

*Attorney, Agent, or Firm*—Klarquist, Sparkman, Campbell, Leigh, Whinston & Dellett

[57] ABSTRACT

A support element (17), an upright support (16) formed of such elements (17) and a support structure (10) further including cranks (11) or shelves supported by the upright supports (16) over described. The structure (10) is intended for supporting ware such as plates in a fast firing kiln. The elements (17) have enlarged apertures (18) with projections (19) on their lower borders to support hooked terminal portions (15) of the cranks loosely, allowing release of thermal stresses and free circulation of kiln gases.

11 Claims, 4 Drawing Figures

SUPPORT ELEMENT, UPRIGHT SUPPORT AND SUPPORT STRUCTURE FOR SUPPORTING ARTICLES DURING KILN FIRING

BACKGROUND OF THE INVENTION

1. Field of the Invention

This invention relates to a support element, an upright support formed of such elements and a support structure further including cranks or shelves supported by such upright supports, for supporting articles during kiln firing.

2. Description of the Prior Art

During the firing of plates and similar articles, the articles have previously been supported by cranks made as unitary structures in refractory material and usually having three generally horizontal legs extending angularly away from the centre of the crank to respective vertically depending stackable feet. The cranks, together with the plates or other articles supported thereon were then stacked in columns on a refractory base and introduced into the kiln for firing of the ware.

Firing of larger articles such as cups, bowls and the like has conventionally achieved by placing the articles on shelves or "bats" supported on upright support pillars or walls. Commonly, some shelves at least are fixed by being trapped between adjacent elements of the support pillars or walls, although intermediate shelves may also be slid onto projecting shelf supports.

Using either of the above described prior arrangements, serious problems are now being encountered because of the introduction of fast firing kilns which will fire ware in typically one hour or less, instead of several hours as was the case with older types of kiln. The introduction of such fast firing kilns is becoming widespread, owing to the rising cost of fuel and to the relative compactness of fast firing kilns.

The supporting structure is now subjected to rapid heating and cooling, which gives rise to relatively high rates of thermal expansion and contraction. The types of support structure outlined above are vulnerable to damage by cracking as a result of the high stresses to which they are subjected during fast firing. This is particularly so because of the way in which the crank feet are effectively clamped in stacks under the load of the supports plus the ware or, in the case of shelf arrangements, the way in which the shelves are clamped rigidly at their edges between the upright support pillars. This rigid clamping under load prevents adequate release of thermal stress.

Further, the large bulk of material present at the stacked crank feet or at the supports of a shelf-type support structure gives rise to thermal inertia on heating and cooling. For example, on heating, the kiln gasses circulating around the surfaces of these relatively massive parts of the structure will heat the surfaces very rapidly while the relatively deep lying inner regions are still cool, causing local stresses in the material. Heat is stored in large quantities in the thick bulky parts of the structure when they have been heated up, which wastes otherwise useful heat, and further gives rise to risk of cracking as the structure cools.

SUMMARY OF THE INVENTION

It is an object of the present invention to provide a new or improved support element, an upright support formed of such elements and a support structure further including cranks or shelves supported by such upright supports, for supporting articles during kiln firing, the element, support or support structure having improved resistance to damage during use in a fast firing kiln.

According to a first aspect, the invention provides a support element for a support structure including refractory cranks or shelves in which an aperture is provided through the element adapted loosely to receive a portion of a crank or shelf, the border of the aperture which is disposed lowermost in use being provided with a plurality of upwardly directed small projections on which said portion is supported.

Preferably, the aperture has a pair of upright borders at a spacing slightly greater than the width of said portion and a top border spaced from the upper surfaces of said projections by a distance substantially greater than the thickness of said portion.

Another aspect of the invention provides an upright support formed from a plurality of supporting elements as set out above, stacked vertically one on another.

The support elements may have co-operating or interfitting locating formations on their respective upper and lower surfaces. For example, the upper surfaces may have a plurality of projections, preferably of truncated prismatic shape and the lower surfaces a corresponding plurality of complimentary recesses, or vice versa.

Viewed from a further aspect, the invention provides a support structure which comprises a plurality of upright supports as set out above and a plurality of cranks or shelves for supporting ware to be fired, each crank or shelf having at least three portions, each of which is received loosely in a respective aperture of a support element on said projections.

The portions may be so shaped and dimensioned in relation to the shape and size of the apertures that said portions can be tilted to a limited extent in the apertures.

The apertures and portions may be of generally rectangular cross-section and the tilting may be limited by the portion reaching a position diagonally across the aperture.

When considered in plan view, the support structure may include three upright supports disposed at the apices of a triangle and the apertures of two of the upright supports may be perpendicular to the apertures of the third upright support.

BRIEF DESCRIPTION OF THE VIEWS OF THE DRAWINGS

The invention will now be described in more detail by way of example only with reference to the accompanying drawings in which.

DETAILED DESCRIPTION OF THE PREFERRED EMBODIMENT OF THE INVENTION

Figure 1:
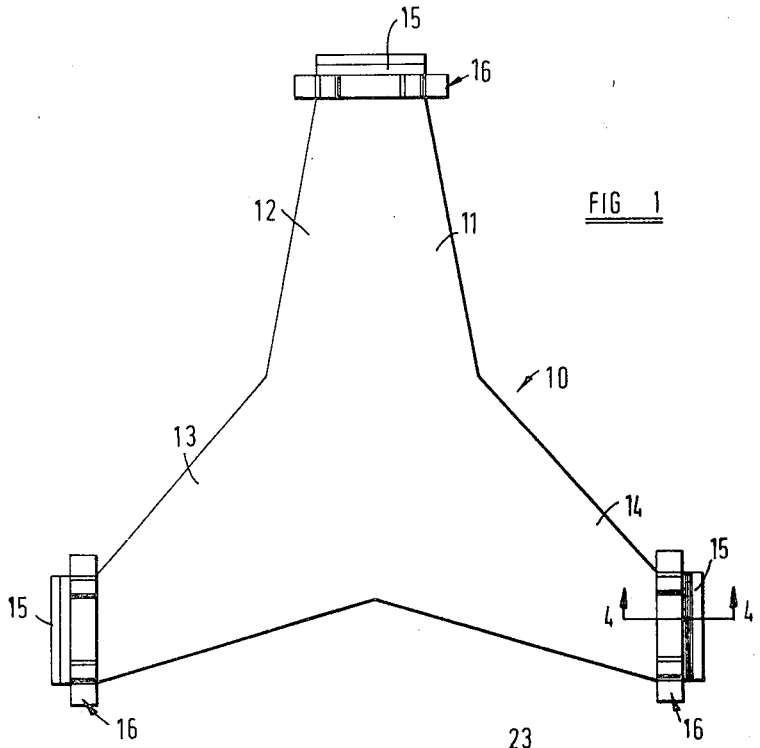
FIG. 1 is a plan view of a support structure embodying the invention and intended for the firing of plates.

Referring firstly to FIG. 1 of the drawings, a support structure generally indicated at 10 is illustrated in plan view. The support structure comprises a stack of cranks 11, each of which is adapted to support an article such as a plate (not shown) intended to be fired in a fast firing kiln. Each crank has three limbs 12, 13, 14 and each limb has a terminal portion 15, by means of which it is supported by upright supports, generally indicated at 16. Each crank is therefore supported at three positions spaced apart at the apices of a triangle. The spacing of the upright supports 16 may be such as to leave a larger opening between one or two pairs of upright supports than between the remaining supports so that a plate or other article to be fired can be introduced to the support structure without dismantling it.

Figure 2:
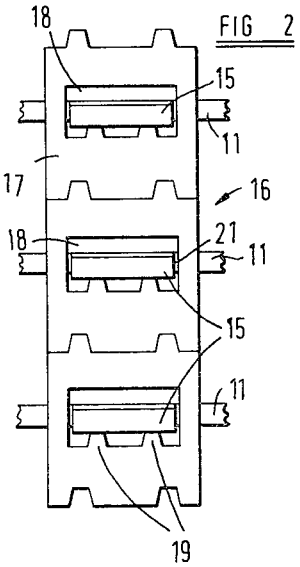
FIG. 2 is a scrap elevational view of one upright support of the structure shown in FIG. 1.
Figure 4:
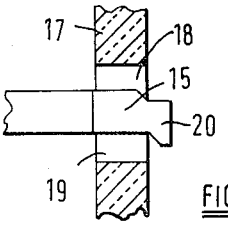
FIG. 4 is a detail sectional view on the line 4—4 of FIG. 1.

FIG. 2 of the drawings shows, in more detail, the construction of one of the upright supports, with the portions 15 of three cranks 11 shown in position. Each upright support 16 comprises a plurality of support elements 17 which are stacked vertically one on another. Each support element 17 has an aperture 18, within which an associated terminal portion 15 of the crank is loosely located. It will be seen that the lower border of the aperture 18 is provided with a pair of small upwardly directed projections 19 which are of truncated prism shape. Referring to FIG. 4 of the drawings, the terminal portion 15 will be seen to be hooked downwardly at 20 to reduce the risk of the crank terminal portion being withdrawn from the aperture 18 accidentally or during use.

The aperture 18 of each support element 17 has a vertical depth which is considerably greater than the thickness of the terminal portion 15 so that there is a clear space above and below the terminal portion, except for the region of the projections 19 which support the terminal portion. The sides of the aperture are also spaced slightly from the side edges of the terminal portion 15 so as to leave a small gap 21 for circulation of kiln gasses.

In use, the crank 11 is effectively allowed to "float" on the upright supports 16 because the terminal portions 15 are only loosely located in the apertures 18. The thermal expansion and contraction of the crank and of the supports therefore does not give rise to the build-up of large stresses in the support structure because the parts of the structure can undergo relative movement to release the stresses which would otherwise be caused.

Figure 3:
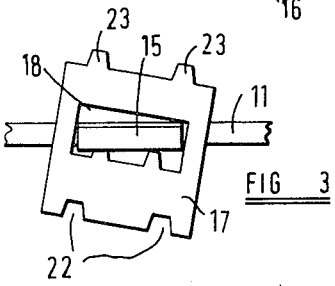
FIG. 3 is a scrap elevational view illustrating tilting of the upright support of FIG. 2.

In addition to the forces exerted by thermal expansion and contraction of the parts of the structure, it is to be expected that passage through a kiln will give rise to vibration and also that the entire structure may be subjected to forces tending to cause the upright supports 16 to tilt. In the support structure described and illustrated, these large scale movements of the structure are extremely unlikely to cause the structure to collapse or topple. The reason for this is illustrated in FIG. 3 of the drawings where a support element 17 is shown tilted at an angle to the crank 11 which it supports. The tilted support element could form part of an upright support which is tilted throughout its length or it might be a single tilted support element in an otherwise straight upright support. Whichever is the case, the terminal portion 15 is not forced to tilt simply because the support element 17 has tilted. Both the aperture 18 and the terminal portion 15 are generally rectangular and the clearance is sufficient to enable the aperture and terminal portion to be tilted until the terminal portion occupies a generally diagonal condition across the aperture as shown in FIG. 3.

Referring back to FIG. 1 of the drawings, it will be seen that two of the upright supports 16 at the lower part of the Figure are disposed in parallel, while the third upright support is disposed at right angles as considered in plan view. This means that, if the support structure as a whole is caused to move angularly in one direction or another, firstly the cranks 11 are not forced into any steep inclined condition and secondly the tilting is resisted by the portions 15 eventually locking in the diagonal condition shown in FIG. 3. Thus, there is a reduced tendency firstly for the ware to be tipped off the cranks and secondly for the support structure as a whole to tilt sufficiently fall over. The structure therefore has self-stabilising properties.

Each of the parts of the structure is formed, preferably by a die pressing operation, in the form of a relatively thin plate of ceramic material. This includes the cranks and each of the support elements. As a result, each part of the structure is of a relatively uniform thickness and there are no very thick sections which could be vulnerable to cracking by reason of their thermal inertia.

When a ceramic structure has a thick cross-section, rapid heating will tend to heat the outer surfaces while the inner parts of the section remain relatively cool, which can give rise to uneven expansion. Conversely, when the thick section has been heated to a high temperature, and is then cooled, the surface will cool more rapidly than the inner parts and cracking may again result.

It will be seen from the drawings that the support structure 10 does not have any such thick parts which would give rise to substantial thermal inertia. Furthermore, the kiln gasses have free access to substantially the entire surface of the terminal portions 15, via the enlarged apertures 18.

The arrangement shown gives rise to a much reduced tendency for any damage to occur due to fast firing because of the novel construction of the cranks and upright supports. The supports themselves are formed on a plurality of small units, namely the support elements 17, which are stacked one on another. The underside of each element has a pair of recesses 22 and the top of each element has a pair of co-operating projections 23 to enable the elements to be stacked in a relatively secure manner. Each of the projections and recesses 23 and 22 is of truncated prismatic form in the example shown.

Although the embodiment of the invention described above is intended for use in firing of plates and therefore consists of pillar-like upright supports carrying cranks, it will be appreciated that the invention is equally well applicable to support structures for firing other types of ware. The upright supports could therefore be in the form of pillars or walls and the cranks could be replaced by shelves or "bats" provided that the shelves were not clamped between adjacent parts of the upright supports but were loosely held by terminal portions disposed within relatively large apertures in the general manner described above.

It has previously been proposed to use apertured supports to receive pegs on which shelves are then supported, for example in British Pat. No. 1,421,504. However, it is believed that such connections have always involved a relatively tight fit between the openings and the portions or pegs which are received in them, in contrast to the extremely loose and free fitting connection described above.

The structure described is particularly designed for use in fast firing kilns but it will be appreciated that it may be used in any form of kiln and may have advantages of low bulk and good stability under such circumstances.

I claim:

1. A support element for a support structure including refractory cranks or shelves for supporting articles during kiln firing, the element being capable of being stacked generally vertically with other elements to form an upright support and having a transverse aperture which extends completely therethrough to receive a portion of a crank or shelf, extends generally horizontally when the element is in use, has dimensions greater than the portion to be supported therein, and is partially defined by a lower border which defines a plurality of small, localized contact points located so that when such a portion is positioned to extend loosely through the aperture, the portion is supported on the contact points so that kiln gases can flow through the aperture and around the portion.

2. A support element for a support structure including refractory cranks or shelves for supporting articles during kiln firing, the element being capable of being stacked generally vertically with other elements to form an upright support for such shelves or cranks, the element having a transverse aperture which extends completely therethrough and is adapted loosely to receive a portion of a crank or shelf, said aperture being defined by (a) a lower border that extends generally horizontally when the element is in use and that defines a plurality of small upwardly directed projections;

(b) an upper border spaced from said projections by a distance substantially greater than the thickness of such a portion; and (c) extending between the upper and lower borders, lateral borders which are spaced apart by a distance slightly greater than the width of such a portion of a crank or shelf.

3. A support element according to claim 2 wherein the aperture is generally rectangular and wherein the lateral borders are disposed generally upright in use.

4. An upright support intended to support refractory cranks or shelves for supporting articles during kiln firing, the upright support being formed from a plurality of support elements as set out in claim 1 or 2, the elements being stacked vertically one on another.

5. An upright support according to claim 4 wherein the support elements have co-operating inter-fitting locating formations on their respective upper and lower surfaces.

6. An upright support according to claim 5 wherein the locating formations are a plurality of inter-fitting projections and recesses of complementary truncated prismatic shape.

7. A support structure for supporting articles during kiln firing which comprises a plurality of upright supports according to claim 4 and a plurality of cranks or shelves for the ware, each crank or shelf having at least three portions each of which is received loosely in a respective aperture of a support element on said projections.

8. A support structure according to claim 7 wherein said portions are so shaped and dimensioned in relation to the shape and size of the apertures that said portions can be tilted to a limited extent in the apertures.

9. A support structure according to claim 8 wherein the apertures and portions are of generally rectangular cross-section and the tilting may be limited by the portion reaching a position diagonally across the aperture.

10. A support structure according to claim 7 wherein, considered in plan view, the support structure includes three upright supports disposed at the apices of a triangle and the apertures of two of the upright supports are perpendicular to the apertures of the third upright support.

11. A support structure for supporting articles during kiln firing comprising a plurality of upright supports, each comprising a plurality of support elements, stacked generally vertically one on another and a plurality of cranks or shelves;

each support element having a transverse aperture which extends completely and generally horizontally therethrough, each crank or shelf having a plurality of support portions each of which is inserted through a respective one of said apertures, the apertures being larger than said support portions so as to receive them loosely, and each aperture being partially defined as a lowermost border which also defines a plurality of small localized contact points to contact said support portion of the crank or shelf.

* * * * *